US006899101B2

(12) United States Patent
Haston et al.

(10) Patent No.: US 6,899,101 B2
(45) Date of Patent: May 31, 2005

(54) LOGICAL DISPLAY FOR A BREATHING APPARATUS MASK

(75) Inventors: David V. Haston, Glendora, CA (US); Nicolo J. Luzie, Jr., Mission Viejo, CA (US); Carl E. Schaefer, Tustin, CA (US); Carl Toft, Vista, CA (US); John Wippler, Fountain Valley, CA (US)

(73) Assignee: Survivair Respirators, Inc., Santa Ana, CA (US)

( * ) Notice: Subject to any disclaimer, the term of this patent is extended or adjusted under 35 U.S.C. 154(b) by 281 days.

(21) Appl. No.: 10/277,842

(22) Filed: Oct. 22, 2002

(65) Prior Publication Data

US 2003/0234018 A1 Dec. 25, 2003

Related U.S. Application Data

(60) Provisional application No. 60/391,102, filed on Jun. 24, 2002.

(51) Int. Cl.[7] ..... A61M 16/00; B63C 11/02; G08B 23/00

(52) U.S. Cl. ..... 128/204.26; 128/201.27; 340/573.1

(58) Field of Search ..... 128/200.24, 200.29, 128/201.15, 201.22, 201.23, 201.24, 201.27, 201.28, 202.27, 204.21, 204.26, 205.25, 205.23, 202.22, 202.24; 2/5, 6.1, 6.2, 6.3, 428, 435, 410; 340/573.1, 573.4, 573.6, 626, 632, 691.1, 693.1–693.5; 345/7, 8, 9; 405/185–187

(56) References Cited

U.S. PATENT DOCUMENTS 3,712,714 A * 1/1973 Uyeda et al. ..... 359/857
4,658,358 A * 4/1987 Leach et al. ..... 73/865.1
4,800,373 A * 1/1989 Mayz ..... 340/626
4,949,072 A * 8/1990 Comerford et al. ..... 340/525
5,097,826 A 3/1992 Gray et al.
5,157,378 A 10/1992 Stumberg
5,601,078 A * 2/1997 Schaller et al. ..... 128/205.23
5,689,234 A 11/1997 Stumberg
5,764,203 A * 6/1998 Holmlund et al. ..... 345/8
5,832,916 A * 11/1998 Lundberg ..... 128/202.22
5,910,771 A 6/1999 Stumberg
5,913,307 A * 6/1999 Taieb et al. ..... 128/205.23
5,990,793 A * 11/1999 Bieback ..... 340/573.1
6,032,664 A 3/2000 Gray
6,095,142 A * 8/2000 Giorgini ..... 128/205.23
6,118,382 A * 9/2000 Hibbs et al. ..... 340/586
6,199,550 B1 * 3/2001 Wiesmann et al. .... 128/204.23
6,201,475 B1 * 3/2001 Stumberg et al. ..... 340/573.1
6,239,770 B1 * 5/2001 Martesuo ..... 345/4
6,334,440 B1 * 1/2002 Cochran ..... 128/201.27
6,360,182 B1 * 3/2002 Hales ..... 702/139
6,447,115 B1 * 9/2002 Gallagher et al. ..... 351/43
6,606,993 B1 * 8/2003 Wiesmann et al. .... 128/204.23
6,675,800 B2 * 1/2004 Keller ..... 128/205.23

* cited by examiner

*Primary Examiner*—Henry Bennett
*Assistant Examiner*—Teena Mitchell
(74) *Attorney, Agent, or Firm*—Knobbe, Martens, Olson & Bear, LLP

(57) ABSTRACT

A mask and regulator for a self-contained breathing apparatus (SCBA) having a lens and a nozzle, the regulator being adapted for connection to the nozzle. A bifurcated display is mounted on the regulator for displaying amounts of pressure through a port communicating with the lens on either side of the nozzle. A high pressure connection to the source of breathing gas is connected to a transducer assembly for indicating the pressure to the bifurcated display on the regulator on either side. The display provides pressure values through the exterior of the lens in a bifurcated manner analogous to an arcuate gauge display.

31 Claims, 8 Drawing Sheets

10
14
12
20
16
34
40
38
36
3
46
75
44
56
58
26
28
3
48
50
18
32
24
30

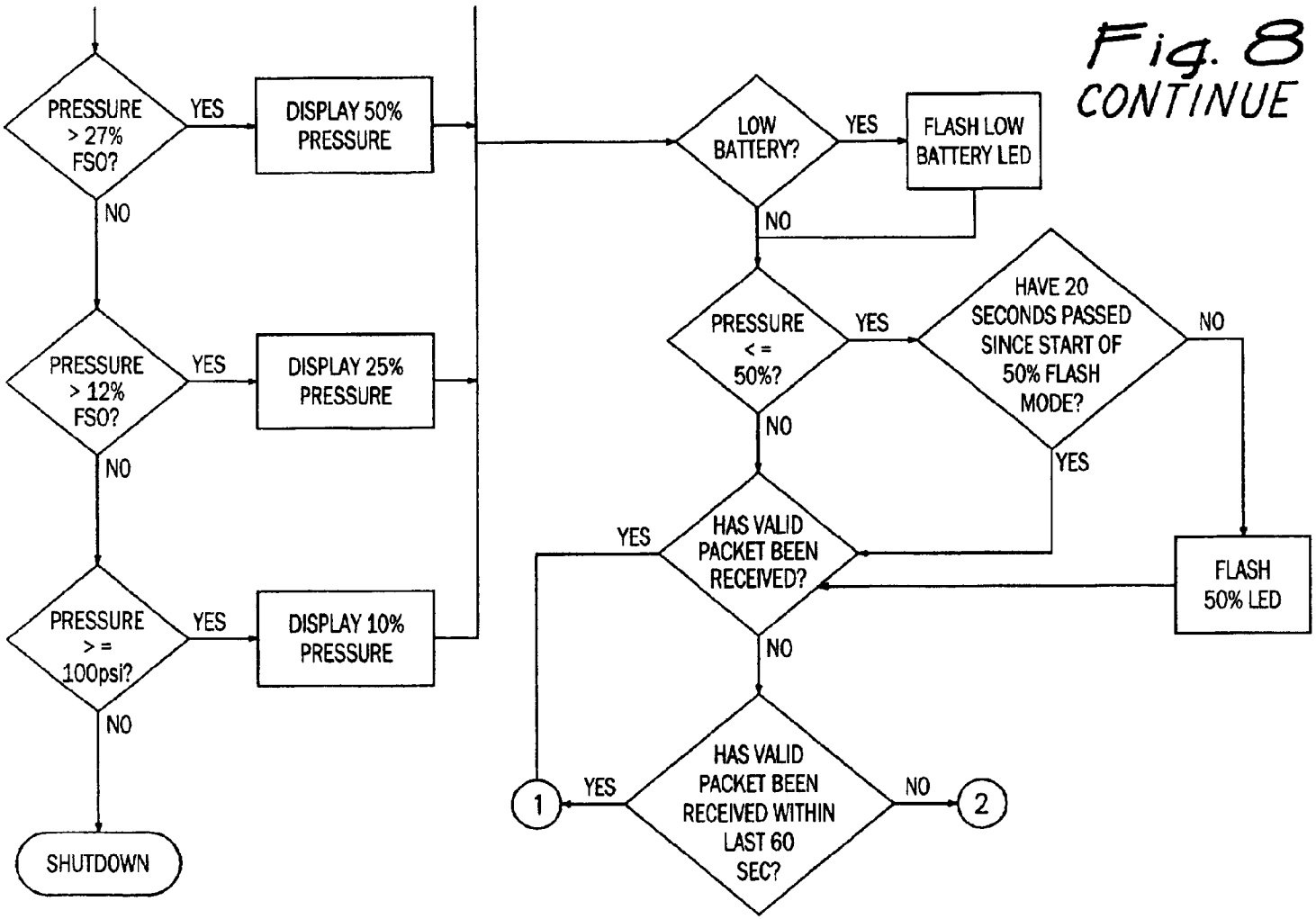
Fig. 8 CONTINUE

LOGICAL DISPLAY FOR A BREATHING APPARATUS MASK

This application claims the benefit and priority of U.S. Provisional Application Ser. No. 60/391,102; filed Jun. 24, 2002; entitled: Display for Breathing Apparatus Mask, Applicants: David V. Haston, Glendora, Calif.; Nicolo J. Luzie Jr, Mission Viejo, Calif.; Carl E. Schaefer, Tustin, Calif.; and, Carl Toft, Vista, Calif.

BACKGROUND OF THE INVENTION

1. Field of the Invention

The field of this invention lies within the art of self contained breathing apparatus sometimes referred to as an SCBA. Such self contained breathing apparatus generally has a pressurized tank of air that is regulated through a first stage regulation to an intermediate pressure which is thereafter regulated to the user by a demand or second stage regulator. The SCBA's of the prior art have incorporated a mask or lens having a nozzle or connector for delivering gas from the second stage regulator to the interior of the mask. The user relies upon a given pressure being provided from the pressurized breathing gas tank, which can be monitored to provide a given reading to the user of the amount of pressure in the tank. This invention specifically relates to the use of SCBA's and the monitoring of the tank pressure through a logical visually readable output.

2. The Prior Art

The prior art with regard to displays for self contained breathing apparatus, (SCBA) have fallen into a number of categories.

Some of these categories have provided an analog display that can be lit or the use of a simple gauge like device. Others use analog pressure gauges which are connected to the tank of air. Still further, some utilize the aspects of a shutter or a series of lights that show a respective amount of air in the breathing gas tank and move in response to a pre-established position to indicate a particular amount of gas remaining.

In some cases, displays have incorporated a moving dial for indicating a particular amount of pressure established from a pressure transducer or other interconnect.

Some of the most recent efforts in this regard to provide a display have been enunciated in U.S. Pat. No. 5,097,826 issued to Robert E. Gray, et al issued Mar. 24, 1992 and U.S. Pat. No. 6,032,664 issued to Robert E. Gray, et al issued Mar. 7, 2000.

U.S. Pat. No. 5,097,826 sets forth a pressure monitoring device. This particular pressure monitoring device while incorporating a transducer and a lighting display is such where it does not logically function for purposes of providing a readable output. One of the problems with U.S. Pat. No. 5,097,826 is that it shows a series of lights along side a user which can occlude the user's field of view. Occluding the user's field of view results in loss of vision. The diminution of the field of vision creates a problem for the user. Also, the U.S. Pat. No. 5,097,826 does not have a logic system for determining the particular gauge like functions which can be responded to in a substantially more user friendly relationship.

U.S. Pat. No. 6,032,664 incorporates a display for an SCBA. However, in this particular patent it is specifically directed toward the aspects of providing a display that can be seen within the field of vision of a single eye of a user. It is stated that by doing this, the position is preferred and prevents the user from seeing a double image.

To the contrary, this invention specifically does not limit the view to a user's single eye as in U.S. Pat. No. 6,032,664.

When considering the non-logical aspects of the prior art displays as well as the reduction in the field of vision and other characteristics that do not provide adequate spacing and reading of a display, it will be seen that this invention is a substantial step over the art for allowing a user to quickly determine remaining air supply.

This improved display does not reduce the field of vision and can be easily seen by a user by looking downwardly into the mask.

Another object of this invention is that the split display is logically intuitive. A user knows readily whether or not the air supply is greater or less than fifty percent. The fifty percent threshold is an important decision point for the user during fire suppression and rescue activities.

A further object of this invention is for the display to provide an external low air alarm so that others can determine if the user's air supply is below a pre-determined level.

Another object of this invention is to eliminate the reduction of the field of vision by those displays which are placed around a lens which obstructs the field of vision.

A further object of this invention is to provide a split display which is incremental on either side in a logical manner within a user's field of vision.

A further object of this invention is to sense the ambient light to regulate the amount of light of the display.

Another object of this invention is to provide a mechanical engagement of the nozzle system and display so that it is oriented correctly and cannot be placed in an upside down or offset position.

SUMMARY OF THE INVENTION

In summation, this invention provides for a self contained breathing apparatus (SCBA) display to determine the amount of pressure in a source (i.e. a cylinder) of breathing gas which does not occlude the field of vision to provide a bifurcated incremental display oriented for logical view with a mechanical engagement to index the orientation of the display.

More specifically, this invention provides for a display of pressure in a breathing gas source such as a cylinder or tank for a user of a self contained breathing apparatus (SCBA). The display mounts to the second stage regulator and nozzle configuration. It is indexed so as to be properly aligned when the regulator is connected to the nozzle and face piece.

The display is viewed through two windows in the normally opaque cover or nozzle structure of the mask.

A further enhancement is that the pressure display is split or bifurcated into left and right portions. This orients the logical aspects of the display so that when the air supply is greater than fifty percent, the display is illuminated on both sides of the display. When the air supply is less than fifty percent, the display is illuminated on the left side only.

An additional feature is that the display has an external visual alarm to alert others to the lessening of a user's air supply.

The field of vision is not reduced by this invention. When looking inwardly into the mask, the user is provided with an intuitive display to readily determine whether an air supply is greater or less than fifty percent in order to make an important decision as to leaving an untenable position.

It will be seen from the following description of the preferred embodiments, that this invention is a substantial step over the art for displays when interconnected to a user's breathing mask of an SCBA.

DETAILED DESCRIPTION OF THE PREFERRED EMBODIMENTS

Figure 1:
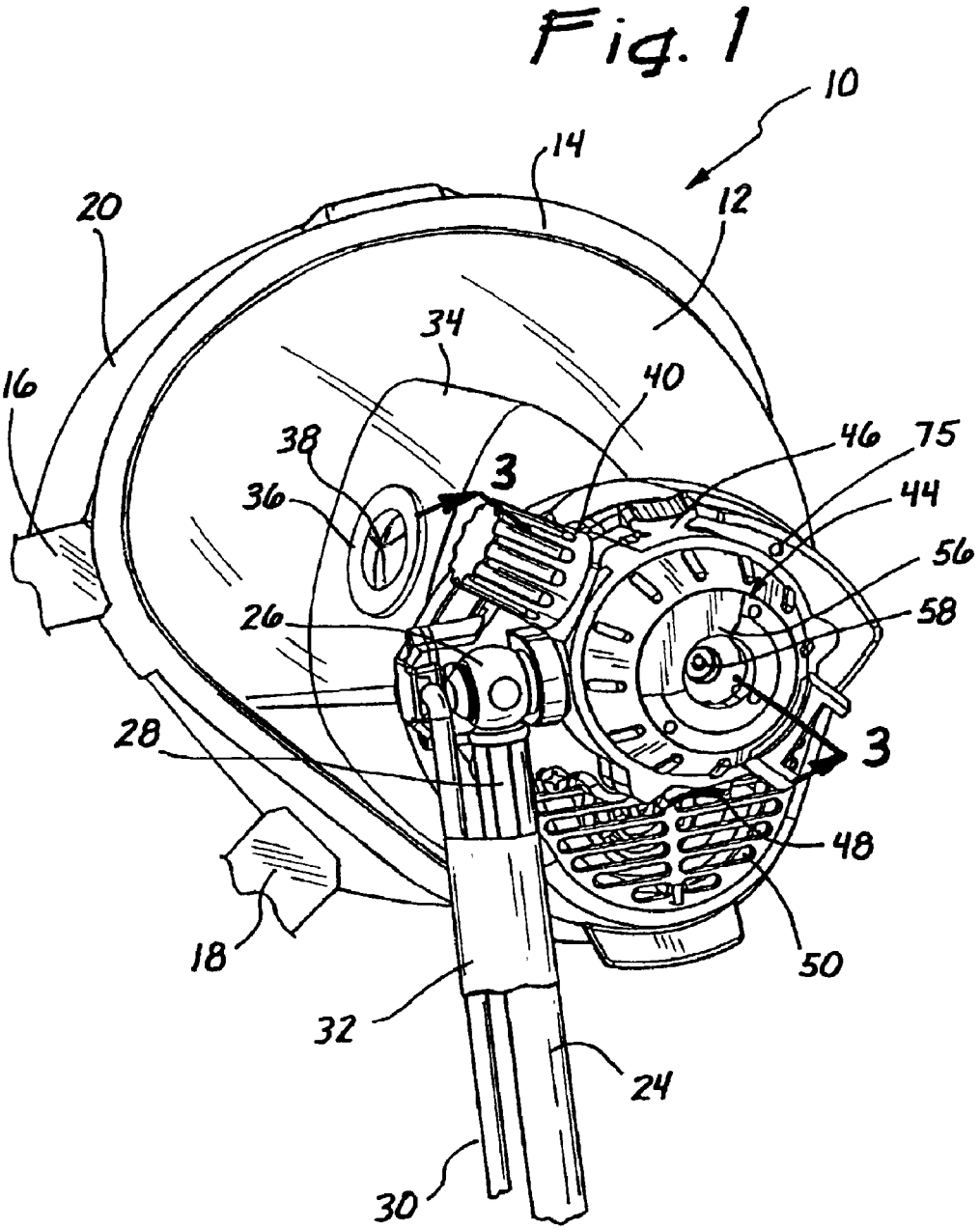
FIG. 1 shows a perspective view of an SCBA mask of this invention with a nozzle connection and structure for receipt of a regulator and display of this invention.

FIG. 1 shows the mask and regulator with this invention. A mask 10 is shown with a lens 12. The lens 12 can be of a quality of plastic or other material through which viewing can take place.

Surrounding the lens 12 is a rim 14. The rim 14 allows for a retention of the lens 12 within the mask 10 configuration.

In order to secure the mask 10 to a user's face, straps 16 and 18 are shown. These straps 16 and 18 can be duplicated on the opposite side as shown in FIG. 1 for tensioning of the mask on a user's head and face. Preferably, the lens 12 has a seal around the rim in the form of a seal 20 which seals the mask 10 against a user's face.

Attached to the mask 10 is a source of breathing gas that is delivered through a hose 24. This source of breathing gas is delivered at an intermediate pressure from a high pressure source such as a tank or cylinder of gas. The intermediate pressure hose 24 connects to a swivel 26 through a fitting 28 which connects the gas to an intermediate, second stage, or demand regulator which will be described hereinafter.

A connecting cable 30 is provided which connects the electrical system in a manner to be described hereinafter. The cable 30 and the hose 24 are encapsulated in a sheath 32 in order to retain them. The sheath 32 has been fragmented away from the hose 24 and cable 30 for purposes of viewing.

The interior of the mask 10 has an oral nasal cover or nose cup 34. This surrounds the nose and mouth of the user so that breathing gas can be inhaled.

Gas is inhaled by inhalation through an inhalation valve 36. The inhalation valve 36 has a web configuration 38 which supports a poppet, mushroom or flapper valve so that air can be inhaled into the oral nasal or nose cup portion 34. This allows the air to be delivered into the mask 10 within the lens area 12 so that condensation and other moisture including exhalation moisture can be diminished and a defogging of the lens 12 can be effected.

A bypass valve operable by a knob 40 is shown. The bypass valve allows for delivery of gas through the hose 24 when the second stage regulator fails or further gas is needed. The knob 40 operating the valve can also throttle the amount of gas that is being delivered.

Attached to the mask 10 is the regulator with its attendant fixtures and other portions to be described hereinafter. The regulator can generally be described as a regulator 44 that is a second stage, demand, or intermediate pressure regulator.

In order to place the regulator 44 on the mask, a pair of spring loaded release buttons 46 and 48 are shown in order to allow for impressment and release of the regulator latch as shown in the figures hereinafter.

An exhalation port with a number of vents 50 is shown. The exhalation port 50 is overlying an exhaust valve so that pressure can be exerted against the interior portion of the exhaust valve and vented through the vents 50.

Overlying the front of the regulator is a purge button or button 56 which can operate a purge valve on a stem 58 underlying the purge button 56. This allows for air to flow into the mask by a manual pressure against the purge button 56 and the underlying valve 58 stem.

The display of this invention is not seen in FIG. 1 due to the fact that the regulator 44 is emplaced thereover and the display is seen from the interior of the mask 10. To this extent, FIG. 2 and the remaining figures show the display as seen within the mask 10.

Figure 2:
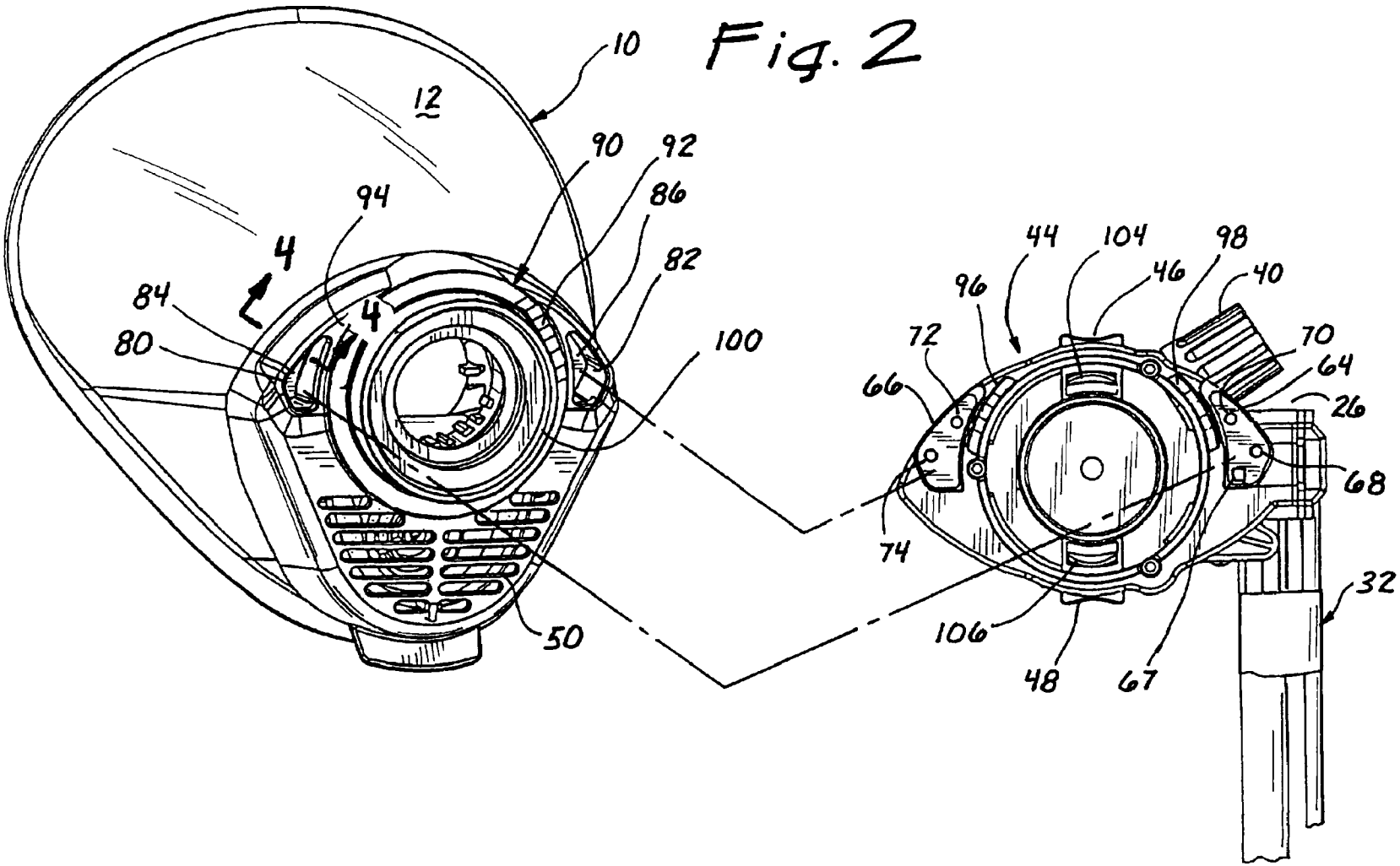
FIG. 2 shows a perspective view of the SCBA mask of this invention with the nozzle connection for receipt of a disconnected regulator and interconnect as separated and established for placement by the dotted indexing lines for receipt by the mask.

Looking more particularly at FIG. 2 it can be seen where the regulator 44 has been removed from the mask 10 as shown by the dotted line removal exploded configuration. This shows the interior portion of the regulator 44 where it seats against the mask 10. Here again, the regulator 44 has release buttons 46 and 48 shown as well as the bypass knob 40. The sheath 32 is shown surrounding the respective hose and cable.

Again, looking at FIG. 2 it can be seen wherein the regulator 44 has bifurcated indicator LEDs on its display that have been split. In particular, the display on the right side is shown as display 64 while the one on the left side is shown as display 66. The displays 64 and 66, although bifurcated, provide a continuity going from one side to the other.

Display 64 has light emitting diodes or other sources for providing a reading of pressure. The display 64 also has a low battery reading indicator 67. Moving around the initial arc of the display 64 is an LED 68 indicating a full tank pressure.

LED 70 indicates three quarters of full tank pressure. Moving to the left side, LED 72 shows one half tank pressure, while LED 74 shows one quarter tank pressure. LED or light 74 is a two color LED which turns from green to red and is flashed for a prescribed period to indicate the one quarter tank pressure. Two color LEDs can also be used to provide initial red flashings with respect to LEDs 68, 70 and 72, or intermittent flashings with the green.

These respective displays 64 and 66 are seated so that they can be viewed through the viewing ports, passages or windows 80 and 82 respectively. The viewing ports 80 and 82 have an opening which passes in toward the lens 12 so that the interior portions 84 and 86 are sealed from the outside and from the displays 64 and 66.

A nozzle assembly, structure or configuration 90 is formed from a plastic with the ports 80 and 82 on either side of the nozzle.

In order to seat the regulator 44 against the mask, it seats within a nozzle fixture 90 of the assembly 89. The nozzle fixture 90 has two offset indexing recesses 92 and 94. The offset recesses are spaced more or less than 180° apart so as to not be bi-laterally symmetrical.

In order to seat and index the regulator 44 into the nozzle fixture 90, a pair of protuberances, engagement extensions, or offset lugs 96 and 98 are provided. These offset lugs 96 and 98 seat within the respective recesses 92 and 94.

The nozzle fixture 90 has an engagement seal, or rim and flange 100 which receives the projections of the release buttons 46 and 48. As can be seen, the release buttons 46 and 48 have arcuate upright projections 104 and 106 which seat behind the engagement seal, or rim and flange 100.

Thus, in order to seat the regulator 44 into the nozzle fixture 90, it is only necessary to rotate the regulator 44 until it seats and indexes the male lugs 96 and 98 into the female indentations 92 and 94. This action automatically depresses buttons 46 and 48, and engage flange 100. As can be seen and referred to here and before, this seating is such where the offset nature of the lugs 96 and 98 is such that they are approximately 130° apart. This prevents the regulator 44 from being seated upside down on the nozzle portion 90. The offset of less than 180° effects the proper indexing of the regulator 44 and nozzle fixture 90.

It should be understood that the nozzle portion or fixture 90 is made of an opaque or nontransparent portion. It can be made transparent if necessary. Nevertheless, it would be difficult to have a transparent nozzle portion 90, due to the internal features but certain types of plastics can be utilized so that much of it is transparent. With a non-transparent nozzle portion 90, the view of the displays 64 and 66 can take place through the ports 80 and 82 which have the lens portion backs 84 and 86 for viewing the displays 64 and 66. Ports 80 and 82 can be fitted with individual focusing lenses (inserts) to enhance viewing of the display LED's.

Figure 3:
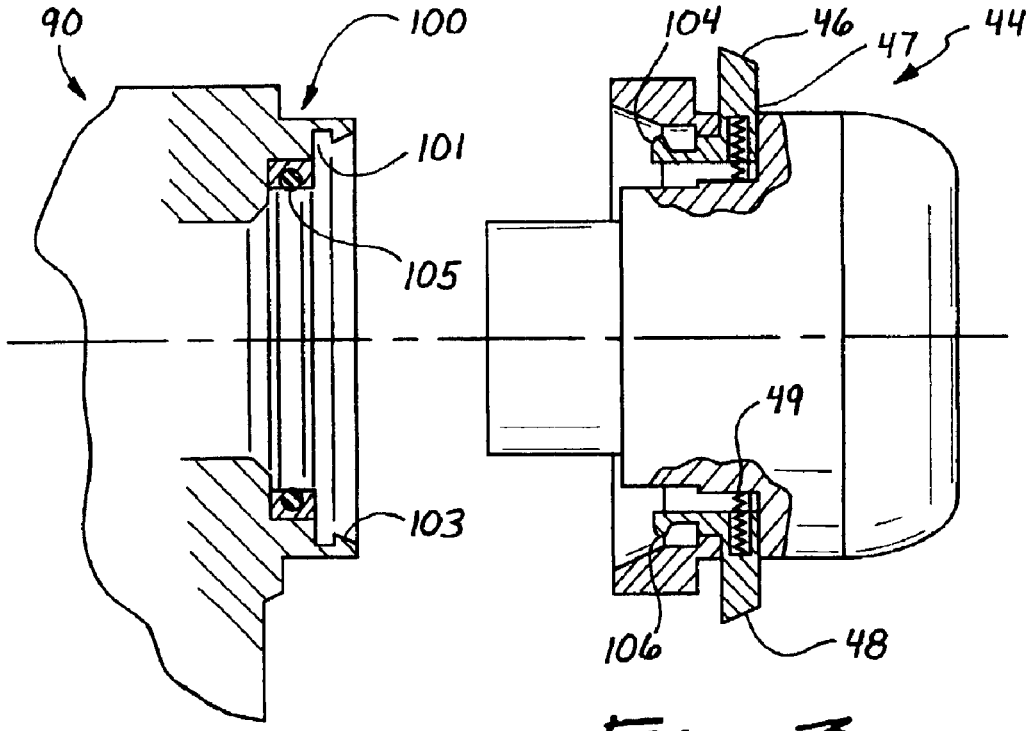
FIG. 3 shows a fragmented sectional view in the direction of lines 3—3 of FIG. 1 with the respective portions of the nozzle and regulator interconnect separated.

Looking more particularly at FIG. 3, it can be seen wherein the spring loaded buttons 46 and 48 are shown. These spring loaded buttons 46 and 48 are biased outwardly by coil springs 47 and 49. At the ends of the buttons 46 and 48 are a pair of upstanding catches 104 and 106. These upstanding catches are received within the engagement seal, rim or flange 100. This is based upon the undercut of the engagement seal 100 and flange in the form of a circular undercut 101 that is provided with a sloping ramp 103 for the respective sloping portions 104 and 106 which slide and engage within the undercut 101.

In order to lock the regulator portion 44 into the nozzle fixture 90, it is merely necessary to rotate the regulator until it seats and indexes within the depressions 92 and 94. This action automatically depresses buttons 46 and 48 and engage flange 100. At this point, an O-ring within a ring seal 105 seals the regulator 44 for the flow of air into the interior of the mask 10 through a nozzle air passage 111.

Figure 4:
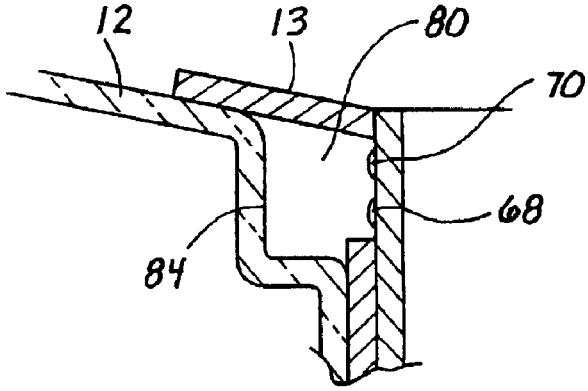
FIG. 4 shows a fragmented sectional view in the direction of lines 4—4 of FIG. 2.

Looking more particularly at FIG. 4, it can be seen wherein the lens 12 has a nozzle cover portion 13 which has the viewing port 80 with the transparent view portion 84. This allows the two respective LEDs 68 and 70 to be viewed through the portion 84. Thus, the sealed integrity of the mask 10 is retained and the lens 12 receives the lighting of displays 64 and 66 through the mask viewed through the lens portions 84 and 86.

Figure 7:
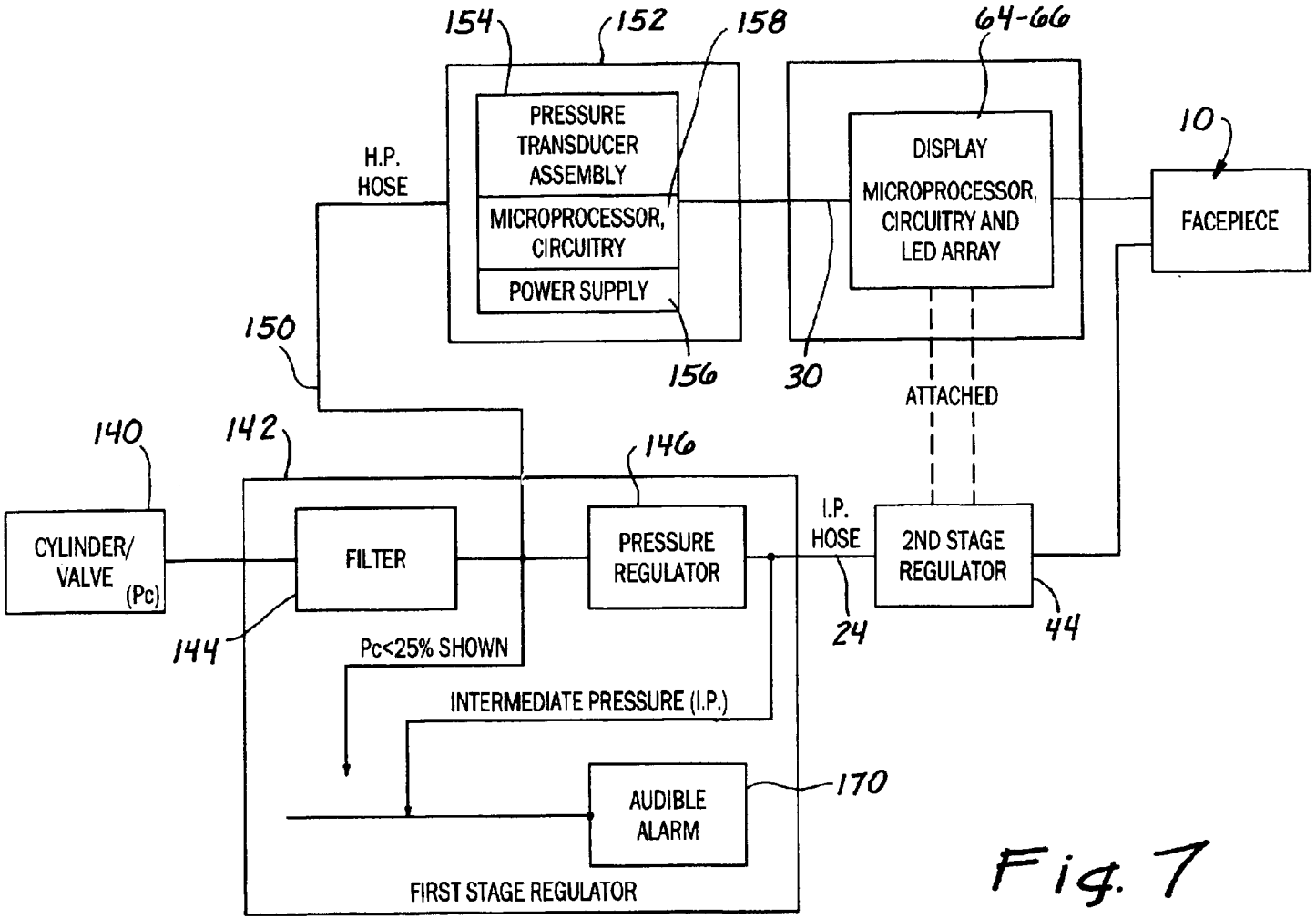
FIG. 7 shows a block diagram of the system incorporating this invention.

In order to have an understanding of the entire system, FIG. 7 shows the system of the entire self-contained breathing apparatus (SCBA) with the respective portions that constitute the invention. In particular, a cylinder 140 with a turn off valve having cylinder pressure (PC) is connected to a first stage regulator assembly 142. The first stage regulator assembly 142 comprises a filter 144 connected to a pressure regulator or first stage regulator 146. The first stage regulator 146 delivers intermediate pressure (IP) through the hose 24 to the second stage or demand regulator 44.

After the air in the line passes through the filter 144, it is bifurcated and received at a high pressure hose connection 150. The high pressure (HP) hose 150 is connected to a combination assembly or transducer module 152 having a pressure transducer 154. The pressure transducer 154 transduces the pressure of the high pressure hose 150 which is equivalent to the cylinder pressure in the cylinder 140.

Within assembly or transducer module 152 is a battery power supply 156 and a microprocessor circuit 158 in order to process the pressure that has been sensed by the pressure transducer 154 into a signal. This particular signal is received at the respective displays 64 and 66 which have conditioning circuitry including a microprocessor and the LED array which constitutes the displays 64 and 66. Of course, the displays 64 and 66 are mounted on the regulator 44 to the nozzle assembly 90 which is connected to the mask 10.

The first stage regular portion 142 can also be provided with an audible alarm 170 that monitors when the cylinder pressure drops below a certain amount. Also, this can be activated when the cylinder pressure (PC) is less than 25%.

Assembly or transducer module 152 is fundamentally connected to the high pressure hose 150 with an interconnect. The power supply, microprocessor and pressure transducer can be in a single assembly 152 connected to the high pressure hose 150. The data output and battery power to the displays 64 and 66 from the assembly 152 is through the wire cable or bundle 30 that is connected to the display.

Figure 9:
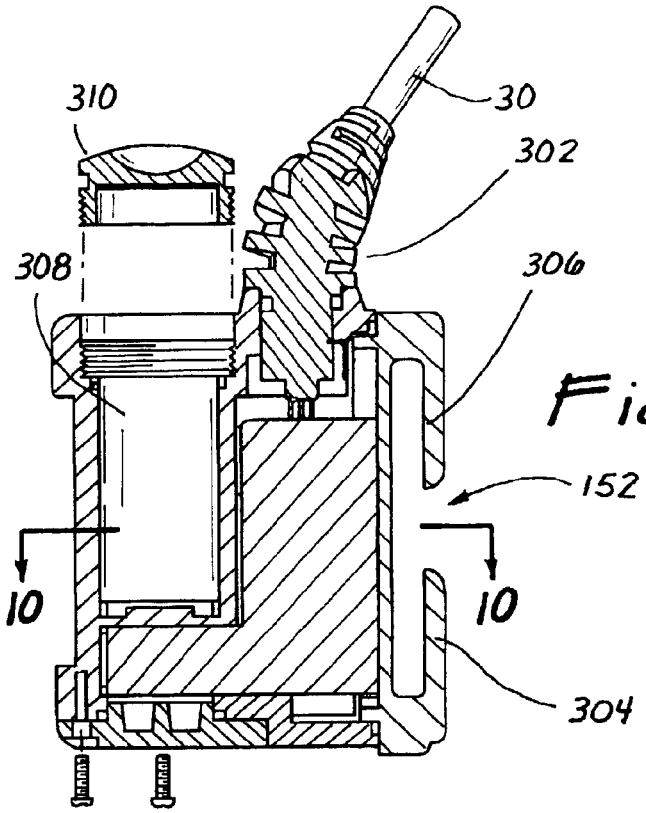
FIG. 9 shows a sectional view of the transducer module or assembly of this invention.
Figure 10:
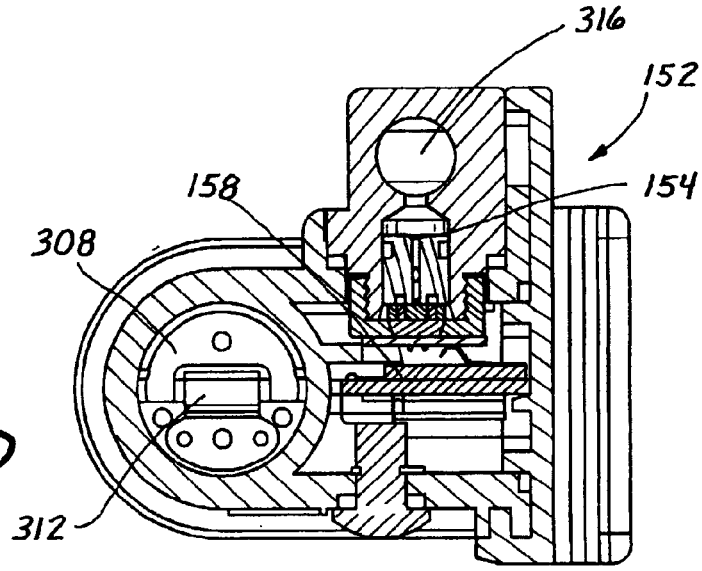
FIG. 10 shows a sectional view in the direction of lines 10—10 of FIG. 9.

Looking more particularly at FIGS. 9 and 10, it can be seen that the pressure transducer module or assembly 152 has been shown. As can be seen it is connected to an output cable which is the electrical and data output on cable 30. This cable 30 is interconnected with the interconnect 302, which has the respective three leads of the cable or bundle. The transducer module 152 is mounted by means of a belt or other assembly that can receive a belt through the loops 304 and 306.

The power supply is in the form of a battery within a battery case 308 into which the battery 156 is inserted. In order to enclose the battery 156, a screw top 310 is utilized for sealing the battery 156 in place.

Looking downwardly into the battery case 308, it can be seen that a battery clip 312 is shown for providing the contacts of the battery terminals.

The high pressure line in the form of the high pressure hose 150 is connected to a cavity or inlet port 316 through which high pressure is delivered to the transducer 154. The transducer 154 provides for pressure measurement so that the microprocessor circuitry 158 can impart the output on the cable 30.

Figure 5:
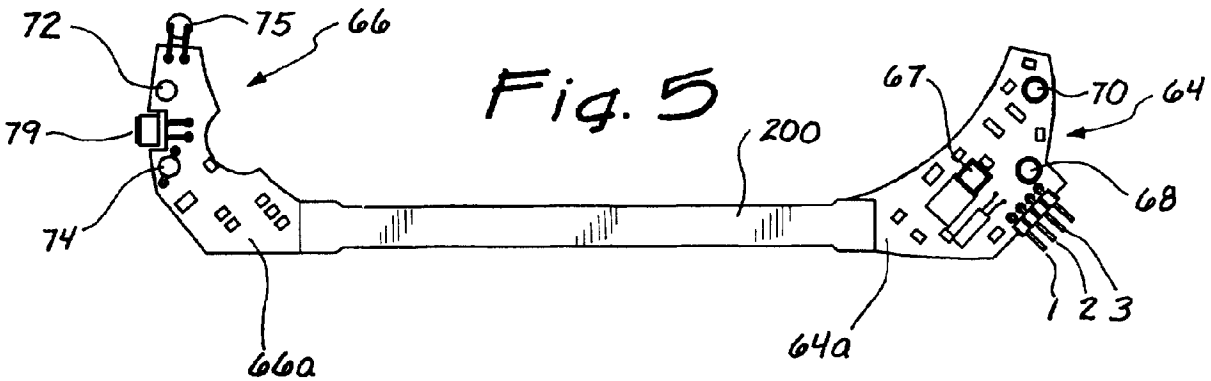
FIG. 5 shows a view of the flex cable and electronic circuitry for the display on either side of the mask.
Figure 6:
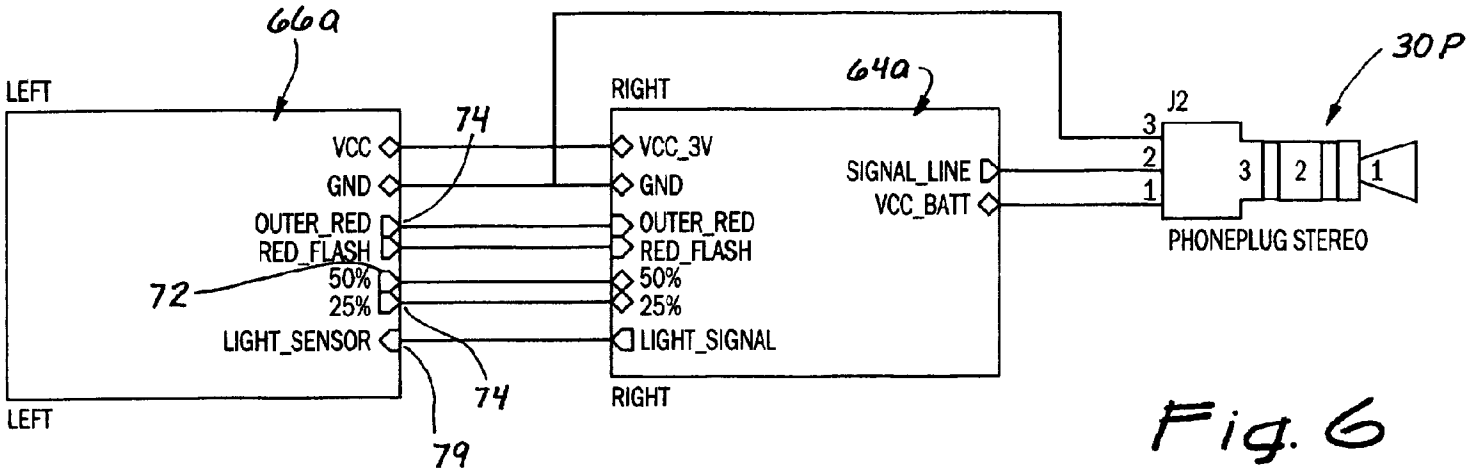
FIG. 6 shows the interconnect orientation between the respective portions of FIG. 5 that have been interconnected.

Looking more specifically at FIGS. 5 and 6, the display circuitry, circuit boards and related items can be seen. In particular, FIG. 5 shows the flex wire connection 200 between the respective left and right sides of the displays 64 and 66. The flex cable 200 interconnects the right side which is interconnected to three particular lines shown as lines 1, 2 and 3 originating from cable 30. Lines 1, 2 and 3 are interconnected by an interconnect via cable 30 to the combination transducer assembly 152 comprising the pressure transducer 154, microprocessor 158, and power (battery) supply 156.

The power supply 156 is shown as VCC battery in FIG. 6 and is connected on line 1. Line 2 is the signal line with respect to the output of the microprocessor circuit 158 that specifically provides for the output on the right and left side of the display, namely right side 64 and left side 66.

The right side 64 with the interconnect has a low battery LED 67. The full pressure LED 68 is shown along with the three-quarter pressure LED 70. These are respectively emplaced on the board which has transistors and other circuit conditioning components.

Interconnected to the right display 64 is the left display 66. The left display 66 has a one-half pressure LED 72 and a one-quarter pressure LED 74. In addition thereto, an external LED 75 is shown. The external LED 75 specifically allows for a display through the regulator 44. A red light or other warning light can be seen by external viewers to determine the fact that the user is running low or approximately at one-quarter pressure in the tank and can be apprised thereof by a party not using the equipment.

A light sensor 79 can be seen. This light sensor 79 is specifically for purposes of determining how much light there is external to the regulator 44. This external light is utilized to determine how bright it is outside and accordingly raise or lower the brightness of the LEDs 68, 70, 72, 74, and 75. In addition thereto, the circuit board for the display 66 has a number of conditioning circuit components such as the transistors seen thereon.

FIG. 6 shows the interconnect to the circuit using a multi-conductor interconnect so that the lines 1, 2, 3 are relatively interconnected by the interfacing connecting portions 1, 2, 3 on cable 30.

The display board 64*a* on the right receives the signal as well as battery power. Also, battery power is provided from the board 64*a* through the flex line 200 to the left hand display board 66*a*. It can be seen that a ground line 3 is also interconnected between the plug 30P and the left and right display boards 64*a* and 66*a*.

The controlling circuitry is on the right hand display board 64*a*. This controlling circuit on board 64*a* communicates the signal for the outer red flashing light or external LED 75 as well as the respective outputs of LEDs 72 and 74 for the fifty percent and twenty-five percent warning as sensed. Finally, in as much as the light sensor 79 is on the left hand side display board 66*a*, it imparts a signal through the flex line 200 back to the circuit board of the display board 64*a* so that it can be processed by the microprocessor circuitry and LED array of the display board 64*a*.

In essence, the output of the transducer module or assembly 152 to the displays along line 30 provides a respective communication line for both processing and power.

Figure 8:
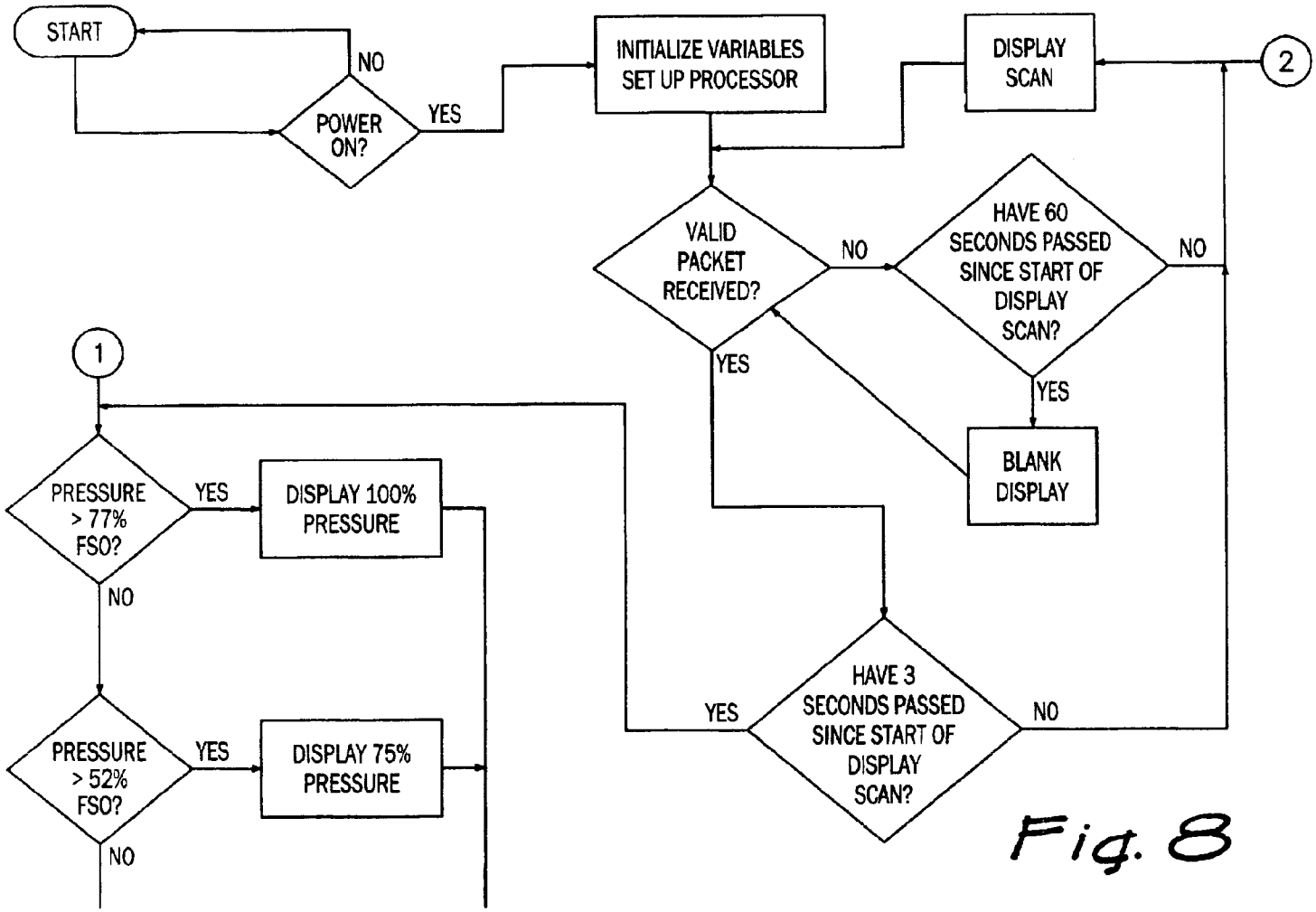
FIG. 8 shows a logic diagram for the implementation of the display of this invention.

FIG. 8 shows the logic of the system with regard to the processor and the respective elements. The system starts when the transducer module or assembly senses pressure in the cylinder or tank 140. At this point, if the power is on it will continue, if not, it will not start until there is pressure sensed.

If the power is on, it initializes the variables in the processor 158. This is fundamentally by zeroing out and ringing out any aspects of the processor 158 in the system which need to start from an initialized format.

After the processor 158 and the system is initialized, it communicates the data information including the pressure, the battery state, the reading of the displays and the other elements to determine if a valid packet of data has been received. If so, the output is passed to the timer to determine if a 3 second delay has been effected since the start of the powering up. If not, the system reverts back to the display scan and the loop continues.

In the eventuality that a valid display packet has not been received, and 60 seconds have passed since the start of the display scan, the display will become blank. This is based upon the fact that interference might take place such as high RF or electromagnetic interference. In the eventuality such interference takes place, the time period of 60 seconds will hopefully avoid the continuation thereof.

If the foregoing criteria are established, then the display starts to function to show the full scale output (FSO) across the respective displays 64 and 66. Here again, the respective 100%, 75%, 50%, 25% and 10% displays are shown. This is based upon the respective pressures being slightly greater i.e. 77%, 52%, 27%, and 12%. The reason for the pressure differential of 2% being sensed greater than the display is to allow for transducer variables in as much as some transducers cannot effect a readout with an error ratio of less than 2%. Therefore, the ±2% error rate of the transducer can be compensated by reading pressures above the respective displays that are to be maintained.

When the pressure is less than 100 psi, the entire display 64 and 66 shut down. This is in order to alert the user to depart since the air is substantially depleted.

In the eventuality of a low battery, the low battery display 67 flashes on so that the display module indicates the low battery. If there is no low battery, and the pressure is less than 52%, the 50% display begins to flash for 20 seconds. This 20 second alarm alerts the user to the fact that the pressure is at approximately 50%.

The continuity of the loops and the connections of the logic are seen with respect to the interconnects encircled in circle 1 and circle 2 to complete the logic loop.

What is claimed is:

1. A mask and regulator for a self-contained breathing apparatus (SCBA) comprising:

a mask having a lens area, seal, and straps for connecting the mask to a user's facial area;

a nozzle for connecting a source of breathing gas to said mask;

a second stage regulator adapted for connection to said nozzle;

a display mounted on said second stage regulator for displaying amounts of pressure in the source of breathing gas; and, at least one port on said mask communicating externally with said lens for viewing said display on said regulator through said port.

2. The mask and regulator as claimed in claim 1 further comprising:

said display is bifurcated into at least two portions.

3. The mask and regulator as claimed in claim 2 further comprising:

said display is bifurcated so that the display indicates higher pressure on one side and lower pressure on the other side of the bifurcation.

4. The mask and regulator as claimed in claim 3 further comprising:

said display is formed with at least four light emitting diodes (LEDS) to indicate various pressures.

5. The mask and regulator as claimed in claim 1 further comprising:

said regulator has an external warning light to indicate a given pressure of the breathing gas.

6. The mask and regulator as claimed in claim 5 further comprising:

a low battery indicator forming part of said display.

7. The mask and regulator as claimed in claim 6 further comprising:

said display is oriented to indicate higher pressure of the breathing gas on the right and lower pressure on the left.

8. The mask and regulator as claimed in claim 1 further comprising:

a light sensor to sense ambient lighting; and, controls to dim or increase said display with respect to the ambient lighting.

9. The mask and regulator as claimed in claim 1 further comprising:

a port on either side of said nozzle terminating in a lens surface for viewing said display on either side through said lens.

10. A self-contained breathing apparatus (SCBA) comprising:

a mask having a viewing lens, straps, and a seal for retaining said mask on a user's face with a nozzle for receipt of breathing gas;

an oral nasal cover communicating with the interior of said mask through which a user can receive breathing gas;

a second stage regulator for connection to said nozzle by a connection fitting;

a source of breathing gas;

a first stage regulator connected to said source of breathing gas and adapted for connection to said second stage regulator through an intermediate pressure conduit;

a high pressure connection to said source of breathing gas connected to a transducer assembly having a transducer for indicating the pressure of said source of breathing gas;

an electrical connection for connection between said second state regulator and said transducer assembly; and, a display on said second stage regulator connected to said electrical connection, said display having a lighted output for viewing through said lens on either side of said nozzle.

11. The SCBA as claimed in claim 10 further comprising:

a viewing port on either side of said nozzle for viewing the display through said lens.

12. The SCBA as claimed in claim 11 further comprising:

said transducer is placed in an assembly having a source of power and a processor for sending pressure data to said display and for powering said display.

13. The SCBA as claimed in claim 12 wherein:

said display is bifurcated between a high and low reading of pressure of said source of breathing gas.

14. The SCBA as claimed in claim 10 further comprising:

said connection fitting has a pair of protuberances and a pair of receipt openings for said protuberances, each of said pair being offset by more or less than 180° for placement in a preestablished orientation.

15. The SCBA as claimed in claim 14 wherein:

said connection fitting has at least one spring biased latch for latching said second stage regulator to said nozzle.

16. The SCBA as claimed in claim 14 wherein:

said display has a power status indicator.

17. The SCBA as claimed in claim 16 further comprising:

an ambient light sensor connected to a processor for causing said processor to change the lighting on said display.

18. The SCBA as claimed in claim 16 further comprising:

an external warning light mounted on an external portion of said SCBA for providing a warning of a given pressure of said breathing gas.

19. A display system for indicating breathing gas pressure of a self-contained breathing apparatus (SCBA) comprising:

a high pressure connection to a source of breathing gas for said SCBA;

a transducer assembly for connection to said high pressure connection;

a source of battery power connected to said transducer assembly;

a processor connected to said transducer assembly;

an electrical connector connected to said transducer assembly including said processor and said source of batter power;

a mask having a lens and a nozzle passing through said lens;

a second stage regulator adapted for connection to said nozzle, said second stage regulator having a bifurcated display for connection to said electrical connector; and, a passage on either side of said nozzle for viewing said bifurcated display on either side of said nozzle.

20. The system as claimed in claim 19 further comprising:

said bifurcated display shows substantially ½ of the pressure on the right side and substantially the remaining ½ on left side.

21. The system as claimed in claim 19 further comprising:

a low battery indicator on said display.

22. The system as claimed in claim 19 further comprising:

at least a portion of said bifurcated display including a flashing signal of a given duration with respect to a given pressure.

23. The system as claimed in claim 19 further comprising:

a pressure warning light outside of said regulator for viewing exteriorly thereof.

24. The system as claimed in claim 19 further comprising:

a light sensor for changing the display intensity.

25. A method for displaying breathing gas pressure in a self-contained breathing apparatus (SCBA) comprising:

providing a SCBA having a source of breathing gas;

providing a transducer assembly fluidically connected to said source of breathing gas;

providing a mask with a lens and a breathing gas nozzle;

connecting a second stage regulator to said nozzle; and, displaying pressure values of said source of breathing gas on said second stage regulator and through the lens of said mask in a bifurcated manner.

26. The method as claimed in claim 25 further comprising:

displaying said pressure values of said breathing gas on either side of said nozzle in a bifurcated graduated manner.

27. The method as claimed in claim 26 further comprising:

providing a battery, processor, and transducer assembly; and, displaying a given battery condition.

28. The method as claimed in claim 27 further comprising:

conducting pressure values from said transducer assembly based upon pressure sensed by said transducer assembly; and driving said display as to pressure by the battery in said transducer assembly.

29. The method as claimed in claim 25 further comprising:

sensing ambient lighting; and, controlling the intensity of the display of pressure values based upon ambient lighting.

30. The method as claimed in claim 25 further comprising:

displaying said pressure values from right to left by a plurality of light emitting diodes.

31. The method as claimed in claim 25 further comprising:

displaying said breathing gas pressure values at least as to a given pressure externally of said mask.

* * * * *

UNITED STATES PATENT AND TRADEMARK OFFICE

CERTIFICATE OF CORRECTION

PATENT NO. : 6,899,101 B2
DATED : May 31, 2005
INVENTOR(S) : David V. Haston

It is certified that error appears in the above-identified patent and that said Letters Patent is hereby corrected as shown below:

Column 9,
Line 44, delete “state” and insert -- stage --.

Column 10,
Line 23, delete “batter” and insert -- battery --.

Signed and Sealed this

Eighteenth Day of April, 2006

JON W. DUDAS
*Director of the United States Patent and Trademark Office*